US007303259B2

(12) United States Patent
Batterton et al.

(10) Patent No.: US 7,303,259 B2
(45) Date of Patent: Dec. 4, 2007

(54) DROP EJECTION ASSEMBLY

(75) Inventors: John C. Batterton, Santa Clara, CA (US); Andreas Bibl, Los Altos, CA (US); Paul A. Hoisington, Norwich, VT (US); Steven H. Barss, Wilmont Flat, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 17 days.

(21) Appl. No.: 10/749,833

(22) Filed: Dec. 30, 2003

(65) Prior Publication Data

US 2005/0140747 A1 Jun. 30, 2005

(51) Int. Cl.
*B41J 2/14* (2006.01)
*B41J 2/045* (2006.01)

(52) U.S. Cl. ..... 347/47; 347/71

(58) Field of Classification Search ..... 347/22–35, 347/36, 47, 54, 56, 71, 100, 106, 40–45
See application file for complete search history.

(56) References Cited

U.S. PATENT DOCUMENTS 3,747,120 A 7/1973 Stemme
4,413,268 A * 11/1983 Bentin ..... 347/47
4,422,082 A * 12/1983 Louzil ..... 347/47
4,613,875 A 9/1986 Le et al.
5,853,861 A * 12/1998 Held ..... 428/207
5,898,444 A * 4/1999 Kobayashi et al. ..... 347/29
6,041,600 A 3/2000 Silverbrook
6,132,028 A * 10/2000 Su et al. ..... 347/47
6,235,212 B1 5/2001 Silverbrook
6,258,286 B1 * 7/2001 Hawkins et al. ..... 216/27
6,264,307 B1 7/2001 Silverbrook
6,439,695 B2 8/2002 Silverbrook
6,520,617 B2 * 2/2003 Blair ..... 347/20
6,536,874 B1 3/2003 Silverbrook
6,582,059 B2 6/2003 Silverbrook

FOREIGN PATENT DOCUMENTS

JP 2-4515 * 1/1990

* cited by examiner

*Primary Examiner*—Stephen Meier
*Assistant Examiner*—Geoffrey S. Mruk
(74) *Attorney, Agent, or Firm*—Fish & Richardson P.C.

(57) ABSTRACT

A drop ejector includes a channel proximate a nozzle opening to control fluid flow.

23 Claims, 4 Drawing Sheets

DROP EJECTION ASSEMBLY

TECHNICAL FIELD

This invention relates to ejecting drops.

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100-300 nozzles/inch, have a resolution of 100 to 3000 dpi or more, and provide drops with a volume of about 1 to 120 picoliters (pL) or less. Drop ejection frequency is typically 10 kHz or more.

Hoisington et al. U.S. Pat. No. 5,265,315, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink jet print assemblies are also described in Fishbeck et al. U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In an aspect, the invention features a drop ejector that includes a flow path in which fluid is pressurized to eject drops from a nozzle opening formed in a substantially planar substrate. Also formed in the substrate proximate the nozzle opening is a channel. The channel is spaced from the nozzle opening by a distance of about 20% of a nozzle width or more.

In another aspect, the invention features a method of fluid ejection that includes providing a drop ejector that includes a flow path in which fluid is pressurized for ejection through a nozzle opening formed in a substrate. Also formed in the substrate proximate the nozzle opening is a channel. The channel is spaced from the nozzle opening by a distance of about 20% of a nozzle width or more. The method also includes providing a fluid that is wicked by capillary forces into the space defined by the channel and ejecting the fluid through the nozzle opening by pressurizing the fluid in the flow path.

Other aspects or embodiments may include combinations of the features in the aspects above and/or one or more of the following. The nozzle opening is surrounded by the channel.

The channel is in the shape of a circle. The channel extends radially from the nozzle opening. The channel has a width that is about twice the nozzle opening width or less. The channel has a width of about 100 microns or less. The channel is from about 2 microns to about 50 microns. The substrate is a silicon material. The planar substrate includes a plurality of nozzle openings and channels proximate the nozzle openings. The nozzle opening width is about 200 microns or less. The drop ejector includes a piezoelectric actuator. The fluid has a surface tension of about 20-50 dynes/cm. The fluid has a viscosity of about 1 to 40 centipoise.

Embodiments may include one or more of the following advantages. Printhead operation is robust and reliable since waste ink about the face of the nozzle plate is controlled to reduce interference with drop formation and ejection. Drop velocity and trajectory straightness is maintained in high performance printheads in which large arrays of small nozzles must accurately eject ink to precise locations on a substrate. The channels control waste ink and permit desirable jetting characteristics with a variety of jetting fluids, such as inks with varying viscosity or surface tension characteristics, and heads with varying pressure characteristics at the nozzle openings. The channels are robust, do not require moving components, and can be economically implemented by machining, e.g. laser machining, or etching, e.g., in a semiconductor material such as a silicon material.

Still further aspects, features, and advantages follow. For example, particular aspects include channel dimensions, characteristics and operating conditions described below.

DESCRIPTION OF DRAWINGS

FIG. 2 is a perspective view of a nozzle plate, while

DETAILED DESCRIPTION

Figure 1:
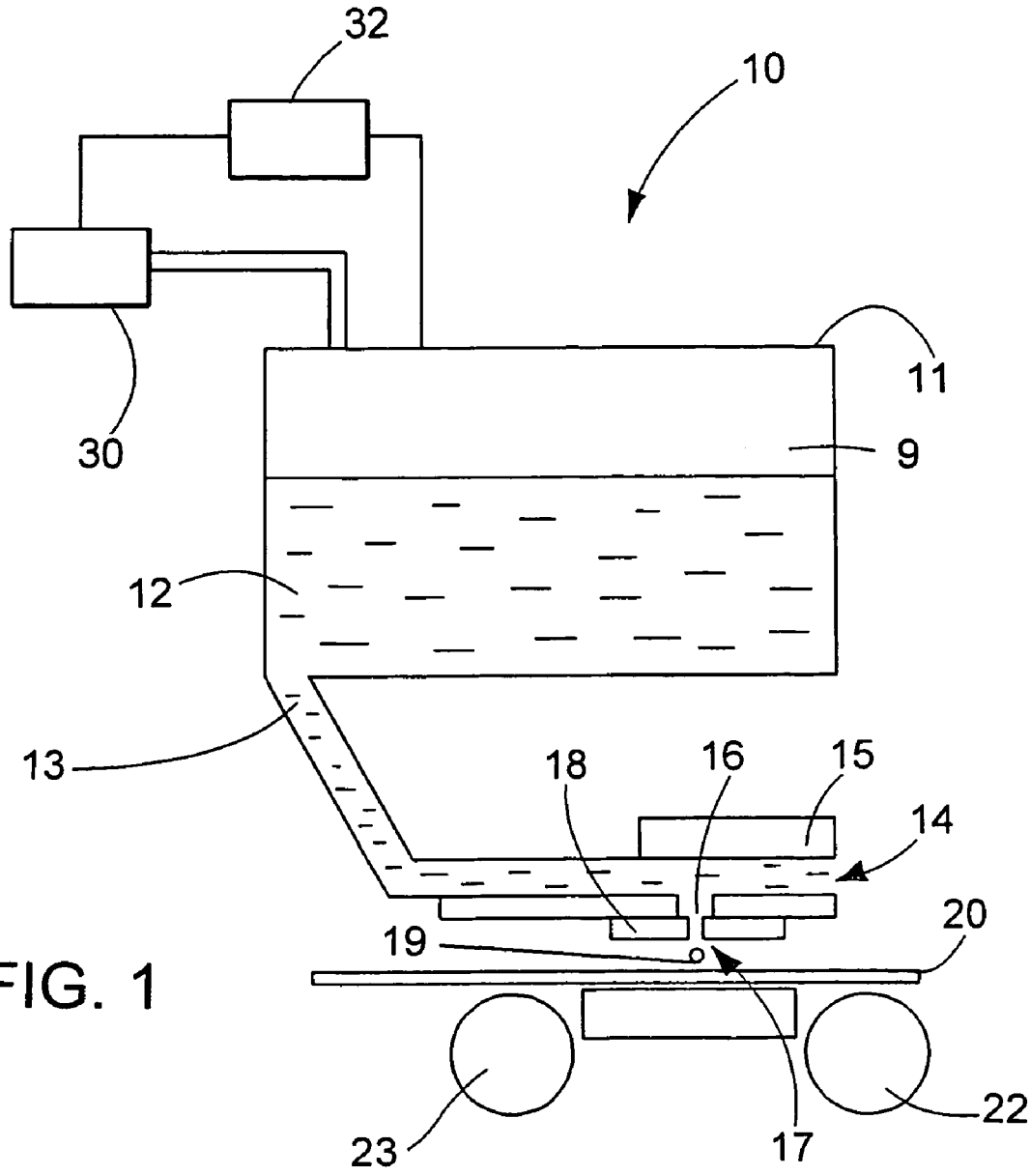
FIG. 1 is a schematic of a drop ejection assembly.

Referring to FIG. 1, an inkjet apparatus 10 includes a reservoir 11 containing a supply of ink 12 and a passage 13 leading from the reservoir 11 to a pressure chamber 14. An actuator 15, e.g., a piezoelectric transducer, covers the pressure chamber 14. The actuator is operable to force ink from the pressure chamber 14 through a passage 16 leading to a nozzle opening 17 in an nozzle plate 18, causing a drop of ink 19 to be ejected from the nozzle 17 toward a substrate 20. During operation, the ink jet apparatus 10 and the substrate 20 can be moved relative to one another. For example, the substrate can be a continuous web that is moved between rolls 22 and 23. By selective ejection of drops from an array of nozzles 17 in nozzle plate 18, a desired image is produced on substrate 20.

The inkjet apparatus also controls the operating pressure at the ink meniscus proximate the nozzle openings when the system is not ejecting drops. Variations in meniscus pressure can cause variation in drop volume or velocity which can lead to printing errors and weeping. In the embodiment illustrated, pressure control is provided by a vacuum source 30 such as a mechanical pump that applies a vacuum to the headspace 9 over the ink 12 in the reservoir 11. The vacuum is communicated through the ink to the nozzle opening 17 to prevent ink from weeping through the nozzle opening by force of gravity. A controller 32, e.g. a computer controller, monitors the vacuum over the ink in the reservoir 11 and adjusts the source 30 to maintain a desired vacuum in the reservoir. In other embodiments, a vacuum source is provided by arranging the ink reservoir below the nozzle openings to create a vacuum proximate the nozzle openings. An ink level monitor (not shown) detects the level of ink, which falls as ink is consumed during a printing operation and thus increases the vacuum at the nozzles. A controller monitors the ink level and refills the reservoir from a bulk container when ink falls below a desired level to maintain vacuum within a desired operation range. In other embodiments, in which the reservoir is located far enough below the nozzles that the vacuum of the meniscus overcomes the capillary force in the nozzle, the ink can be pressurized to maintain a meniscus proximate the nozzle openings. In embodiments, the vacuum is maintained at about 0.5 to about 10 inches of water.

Figure 2:
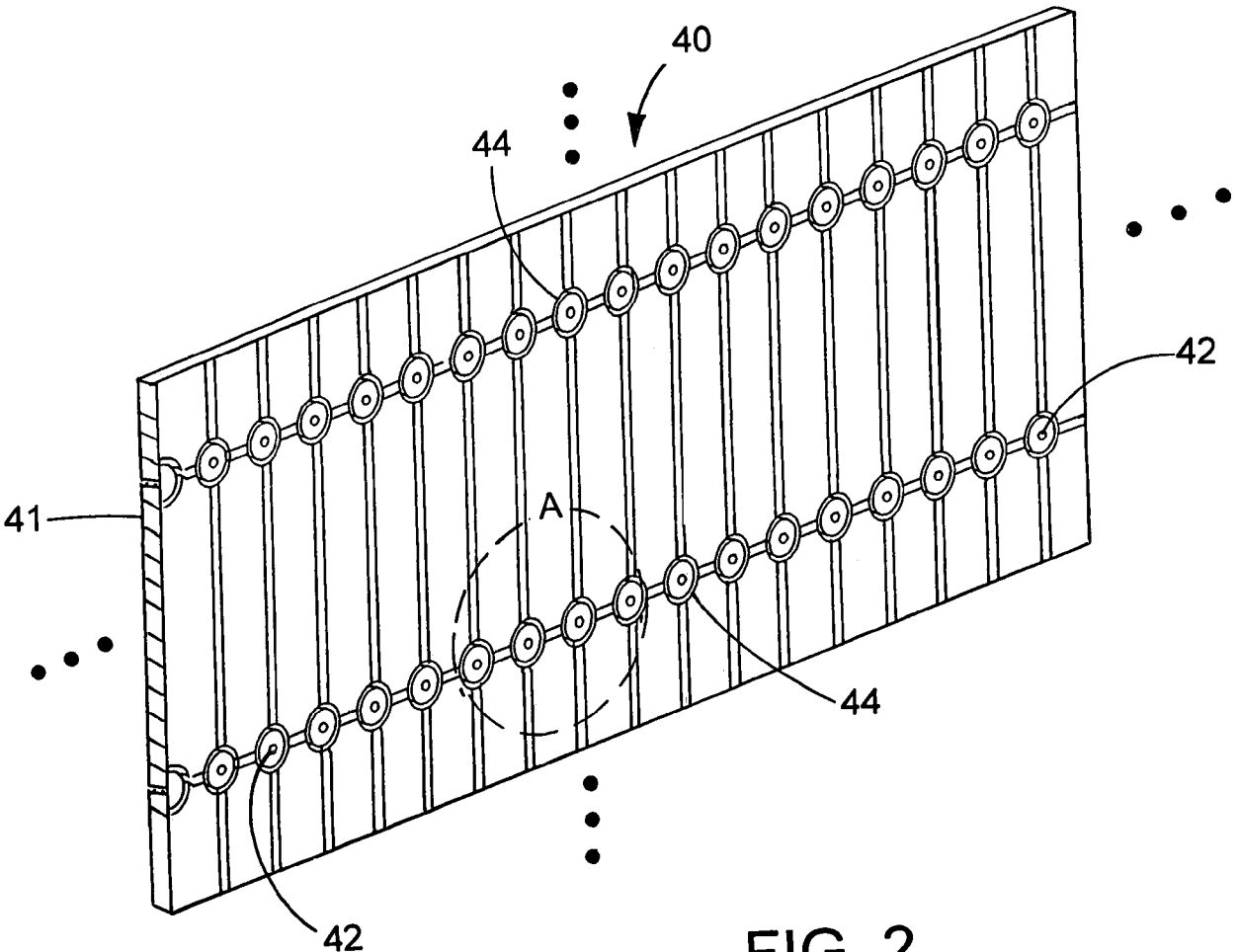
Figure 2A:
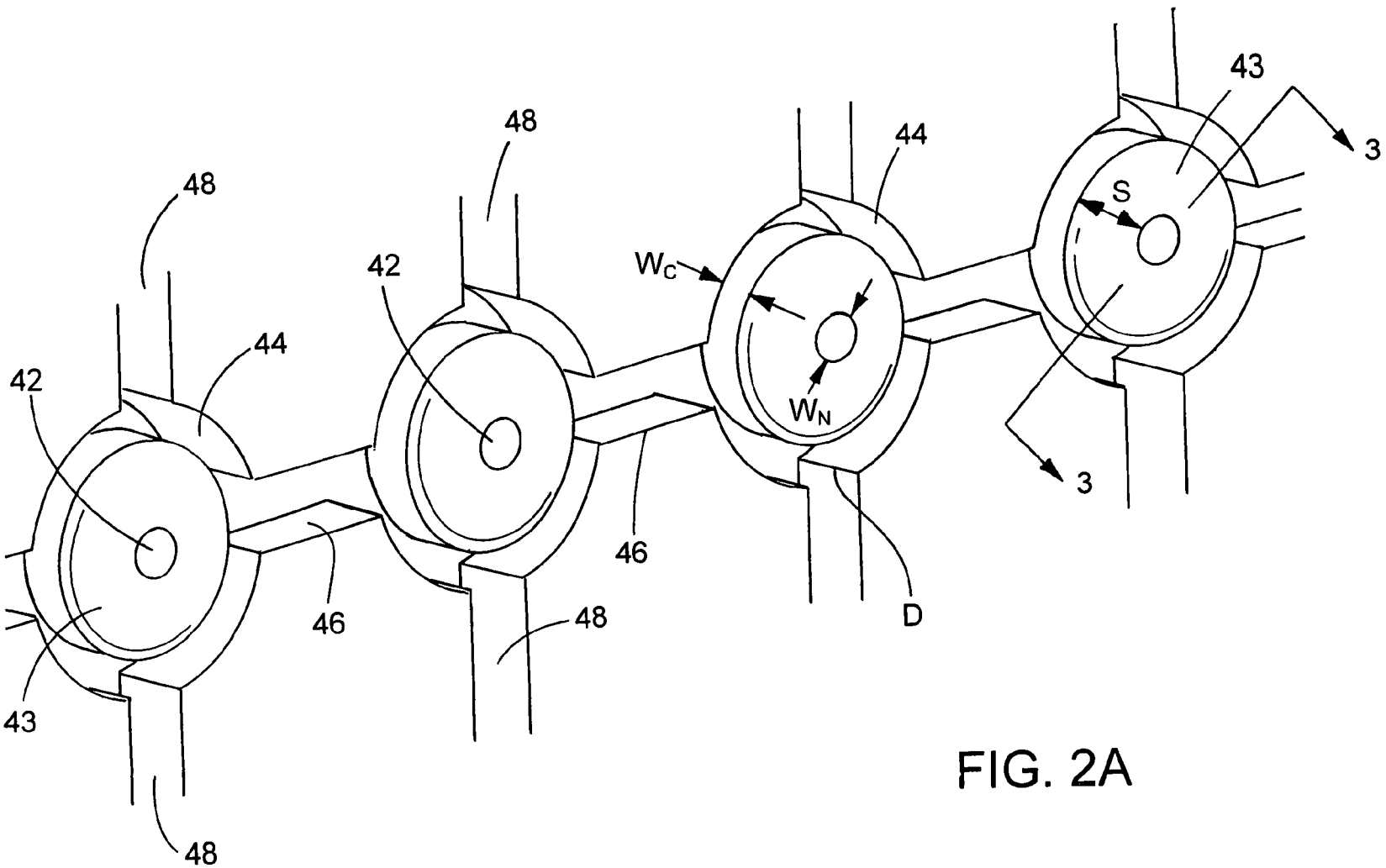
FIG. 2A is an expanded view of region A in FIG. 2.

Referring to FIGS. 2-2A, nozzle plate portion 40 includes a plurality of nozzle openings 42 formed in a substantially planar substrate 41. Also formed in substrate 41 proximate each nozzle opening 42 is a cleaning structure in the form of a radial channel 44. Radial channels 44 control stray ink on the nozzle plate that could affect nozzle performance. For example, during ink jetting, ink may end up collecting on the nozzle plate. Over time, ink can form puddles which cause printing errors. For example, puddles near the edge of a nozzle opening can effect the trajectory, velocity or volume of the ejected drops. Also, a puddle could become large enough so that it drips onto printing substrate 20 causing an extraneous mark. The puddle could also protrude far enough off the nozzle plate 40 surface that the printing substrate 20 comes into contact with it, causing a smear on the printing substrate 20. The radial channels 44 collect, localize and direct waste ink. Referring particularly to FIG. 2A, radial channels 44 completely surround each nozzle opening 42 that is centered on platform area 43. Channels 44 are connected by connecting channels 46 and 48 that emanate from radial channels 44, forming a network of connected channels that direct and hold stray fluid on the nozzle plate.

Figure 3:
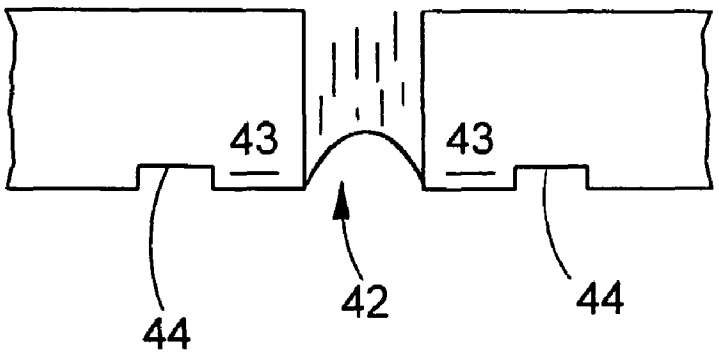
FIGS. 3-3C are cross-sectional views of a nozzle, taken along 3-3 of FIG. 2A, illustrating drop ejection.
Figure 3A:
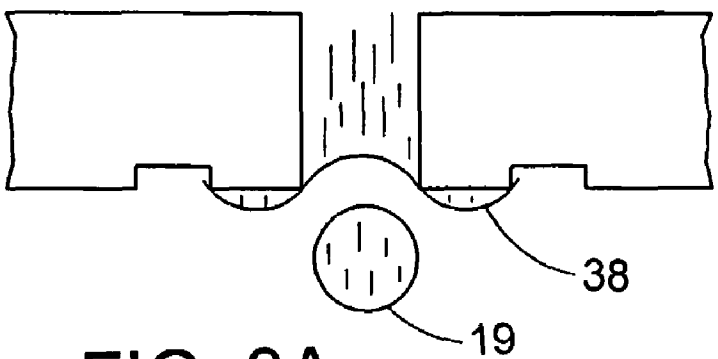
Figure 3B:
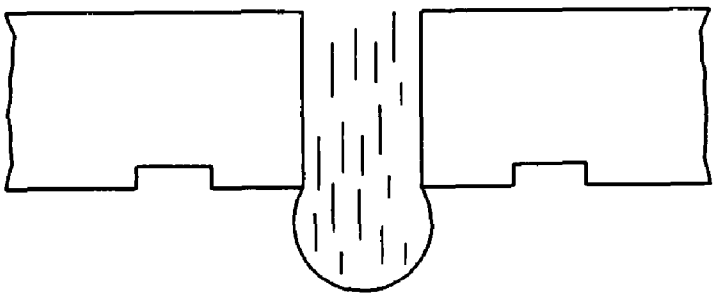
Figure 3C:
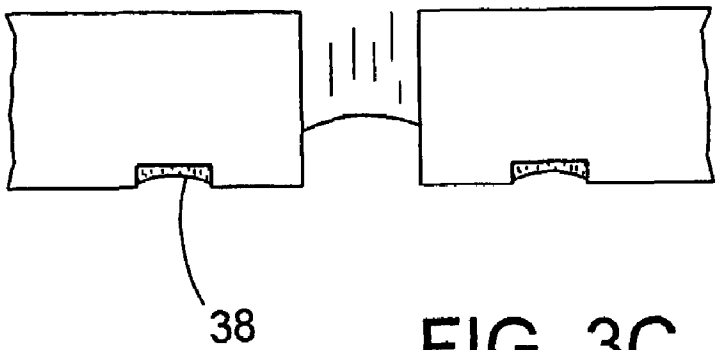

Referring particularly to FIG. 3, a nozzle opening 42 with an adjacent radial channel 44 is illustrated before drop ejection. Referring to FIGS. 3A and 3B, waste ink 38 deposits on platform area 43 and is drawn into radial channel 44 by capillary forces. Referring to FIG. 3C, waste ink 38 is contained and distributed about nozzle opening 42 by radial channel 44. Upon encountering connecting channels 46 or 48, ink moves into the space defined by the connecting channel and then moves under capillary action radially away from nozzle opening 42 and into the network of connected channels that direct and hold stray fluid (see FIG. 2). When the nozzle plate is oriented vertically, waste ink moves through the network of channels under the influence of both gravity and capillary action, macroscopically in a single direction. When the nozzle plate is oriented horizontally, a vacuum source or wicking material can be used to remove ink from the channels.

The spacing, size and orientation of the channels are selected to control waste ink. In embodiments, the spacing, S, from an edge of the channel to an edge of the nozzle opening is between about 20% of a nozzle width, $W_N$, or more, e.g., 30% or more, and about five times the nozzle width or less, e.g., three times the nozzle width or less. The width, $W_C$, and depth, D, of the channel is selected to prevent excessive pooling of ink on the nozzle surface and to allow fluid to be drawn into the space defined by the channel and retained by capillary forces. In embodiments, the channel width is between about twice the nozzle width or less and about 10% of the nozzle width or more. In particular embodiments, the channel width, $W_C$, is, e.g., about 100 microns or less, e.g., 5-20 microns, and the channel depth, D, is, e.g., about 2-10 microns or more, e.g., 50 microns. In embodiments, the nozzle width $W_N$ is, e.g., about 200 microns or less, e.g., 25-100 microns and the spacing S from the nozzle opening to the edge of the channel is, e.g., 40 microns or greater, e.g., 100 microns. In embodiments, the nozzle pitch is about 25 nozzles/inch or more, e.g., about 300 nozzles/inch, the ink drop volume is about 1 to 70 pL and the fluid is pressurized by a piezoelectric actuator. In embodiments, the jetting fluid has a viscosity of about 1 to 40 centipoise and a surface tension of about 20-50 dynes/cm. In embodiments, the jetting fluid is ink. In embodiments, the channels can include a wicking material and/or a nonwetting coating (e.g., TEFLON® fluoropolymer) can be applied to the nozzle plate surface between the nozzle and the channel. The channel network can also be in communication with a vacuum source (not shown). Waste ink can be returned to the main ink supply or to a separate suction system. In embodiments, the orientation of the channel is circular. In other embodiments, the orientation of the channel is sinuous.

The channels and/or the nozzle opening in any of the above described embodiments can be formed by machining, electroforming, laser ablation, and chemical or plasma etching. The channels can also be formed by molding, e.g., injection molded plastic channels. In embodiments, the channel, nozzle opening, and pressure chamber are formed in a common body. The body can be a metal, carbon or an etchable material such as silicon material, e.g., silicon or silicon dioxide. Forming printhead components using etching techniques is further described in U.S. Ser. No. 10/189,947, filed Jul. 3, 2002, and U.S. Ser. No. 60/510,459, filed Oct. 10, 2003, the entire contents of each are hereby incorporated by reference.

The channels can be used in combination with other waste fluid control features such as apertures described in U.S. Ser. No. 10/749,829, filed Dec. 30, 2003, wells as described in U.S. Ser. No. 10/749,622, filed Dec. 30, 2003 and/or projections as described in U.S. Ser. No. 10/749,816, filed Dec. 30, 2003. For example, a series of projections can be included on the nozzle face proximate the channels.

In embodiments, the drop ejection system can be utilized to eject fluids other than ink. For example, the deposited droplets may be a UV or other radiation curable material or other material, for example, chemical or biological fluids, capable of being delivered as drops. For example, the apparatus described could be part of a precision dispensing system. The actuator can be an electromechanical or thermal actuator. The cleaning structures can be combined with a manual or automatic washing and wiping system in which a cleaning fluid is applied to the nozzle plate and wiped clean. The cleaning structures can collect cleaning fluid and debris rather than jetted waste ink.

Still other embodiments are within the scope of the following claims.

What is claimed is:

1. A drop ejector, comprising:

a flow path in which fluid is pressurized to eject drops from a nozzle, the nozzle having an inlet and an outlet, and the outlet being formed in a substantially planar substrate and lying in a plane defined by a surface of the substrate;

a radial channel formed in the substrate on the same surface as the outlet, the radial channel having dimensions configured to and being spaced from the outlet a distance to draw fluid into the space defined by the radial channel, a portion of the radial channel being below the plane defined by the surface of the substrate; and at least one connecting channel formed in the substrate and extending from the radial channel, the connecting channel being configured to move fluid away from the outlet.

2. The drop ejector of claim 1 wherein the radial channel has a width that is about twice the outlet width or less.

3. The drop ejector of claim 1 wherein the radial channel has a width of about 100 microns or less.

4. The drop ejector of claim 1 wherein a depth of the radial channel is from about 2 micron to about 50 micron.

5. The drop ejector of claim 1 wherein the substrate is a silicon material.

6. The drop ejector of claim 1 wherein the planar substrate includes a plurality of nozzles and radial channels proximate the nozzles.

7. The drop ejector of claim 1 wherein the outlet width is about 200 micron or less.

8. The drop ejector of claim 1 including a piezoelectric actuator.

9. The drop ejector of claim 1 wherein the radial channel is spaced from the outlet by a distance of about 20% of an outlet width or more.

10. The drop ejector of claim 1 further comprising a vacuum source in communication with the connecting channel.

11. The drop ejector of claim 1 further comprising a wicking material in communication with the connecting channel.

12. The drop ejector of claim 1 wherein fluid is drawn into the space defined by the radial channel during jetting.

13. A drop ejector, comprising:

first and second flow paths in which fluid is pressurized to eject drops from first and second nozzles, the nozzles each having an inlet and an outlet, and the outlet being formed in a substantially planar substrate and lying in a plane defined by a surface of the substrate;

first and second radial channels formed in the substrate on the same surface as the outlets, the radial channels having dimensions and being spaced from the outlets a distance configured to draw fluid into the space defined by the radial channels, a portion of the radial channels being below the plane defined by the surface of the substrate; and first and second connecting channels formed in the substrate and extending from the first and second radial channels, and a third connecting channel connecting the first and second radial channels, the connecting channels being configured to move fluid away from the outlet.

14. The drop ejector of claim 13 wherein the first and second channels are in the shape of a circle.

15. A method of fluid ejection, comprising:

ejecting a drop through a nozzle having an inlet and an outlet formed in a substrate and lying in a plane defined by a surface of the substrate;

positioning a radial channel in the substrate proximate the nozzle opening on the same surface as the outlet;

providing at least one connecting channel in the substrate, the connecting channel extending from the radial channel;

drawing fluid into the radial channel during fluid ejection, the fluid moving from the radial channel into the connecting channel, a portion of the radial channel being below the plane defined by the surface of the substrate.

16. The method of claim 15 wherein the fluid has a surface tension of about 20-50 dynes/cm.

17. The method of claim 15 wherein the fluid has a viscosity of about 1 to 40 centipoise.

18. The method of claim 15 wherein the radial channel is spaced from the outlet by a distance of about 20% of an outlet width or more.

19. The method of claim 15 further comprising providing a vacuum source in communication the connecting channel.

20. The method of claim 15 further comprising providing a wicking material in communication with the connecting channel.

21. The method of claim 15 wherein the fluid is drawn into the radial channel by capillary forces.

22. The method of claim 15 wherein the fluid is drawn into the radial channel by gravity.

23. The method of claim 15 wherein fluid is drawn into the space defined by the radial channel during jetting.

* * * * *